US007771335B2

(12) United States Patent
Wingate et al.

(10) Patent No.: US 7,771,335 B2
(45) Date of Patent: Aug. 10, 2010

(54) APPARATUS AND METHOD FOR CUTTING AND FOLDING PRINTED PRODUCTS

(75) Inventors: Mark Anthony Wingate, New Durham, NH (US); Michael Lee Hearn, Dover, NH (US)

(73) Assignee: Goss International Americas, Inc., Durham, NH (US)

( * ) Notice: Subject to any disclaimer, the term of this patent is extended or adjusted under 35 U.S.C. 154(b) by 0 days.

(21) Appl. No.: 12/077,996

(22) Filed: Mar. 24, 2008

(65) Prior Publication Data

US 2009/0239727 A1 Sep. 24, 2009

(51) Int. Cl.
*B31B 1/14* (2006.01)

(52) U.S. Cl. ..... 493/356; 493/428; 493/432

(58) Field of Classification Search ..... 493/356, 493/428, 432, 419

See application file for complete search history.

(56) References Cited

U.S. PATENT DOCUMENTS 5,072,919 A * 12/1991 Schneider et al. ..... 270/49
5,242,367 A 9/1993 Marmin
5,386,979 A 2/1995 Muller
5,676,630 A 10/1997 Mayr
6,367,792 B1 4/2002 Chagnon
6,612,213 B1 9/2003 Bredenberg et al.
7,011,617 B2 * 3/2006 Sappal et al. ..... 493/424
7,217,233 B2 * 5/2007 Masaki et al. ..... 493/432
2003/0096688 A1 5/2003 Lange
2008/0067225 A1 3/2008 Moore ..... 229/194

* cited by examiner

*Primary Examiner*—Sameh H. Tawfik
(74) *Attorney, Agent, or Firm*—Davidson, Davidson & Kappel, LLC

(57) ABSTRACT

An apparatus for cutting and folding printed products is provided. The apparatus includes a perforator, a first cutting device creating first slits in the web, a second cutting device creating second slits in the web longitudinally offset from the first slits so as to form a signature with a staggered edge, and a folder delta-folding the signature so that the staggered edge engages slots in the signature, the slots created by the perforator. A method of folding a printed product and a signature are also provided. Lead edges can be more easily prevented from dislodging and dog-earing and skewing can be minimized.

4 Claims, 8 Drawing Sheets

APPARATUS AND METHOD FOR CUTTING AND FOLDING PRINTED PRODUCTS

BACKGROUND OF INVENTION

The present invention relates generally to a printing press and specifically to a printed product cutting and folding apparatus and method.

U.S. Pat. No. 5,386,979 discloses a rotary folding apparatus with a special cylinder arrangement for web-fed rotary printing presses. After a desired mode of operation, first and second cross-fold or delta-fold, has been pre-set and respective folding jaws have been positioned, the formation of the first cross-fold occurs by pushing or tucking copies or signatures into the folding jaws with the aid of tucker blades on a tucker blade cylinder, the folding jaws being in either a first or second position, depending upon the mode of operation. The copies or signatures formed with a first cross-fold are removed from the circumference of the folding jaw cylinder by a gripper bar of a gripper cylinder. Tucker blades of the gripper cylinder push or tuck the copies or signatures into the suitably positioned folding jaws of the folding jaw cylinder so as to form the second cross-fold or the delta-fold.

U.S. Patent Pub. 2003/0096688 discloses a variable circumference folder. From a gathering cylinder, products are transferred from pin systems into folding jaws of a folding-jaw cylinder by a folding blades under control to produce a first crossfold. The products may then be subjected to further folds using known techniques. For example, a double parallel or delta-fold is produced by the products being transferred to gripper systems of a second crossfold cylinder and pushed into folding jaws of the folding-jaw cylinder by folding blades.

BRIEF SUMMARY OF THE INVENTION

An apparatus for cutting and folding printed products is provided. The apparatus includes a perforator, a first cutting device creating first slits in the web, a second cutting device creating second slits in the web longitudinally offset from the first slits so as to form a signature with a staggered edge, and a folder delta-folding the signature so that the staggered edge engages slots in the signature, the slots created by the perforator.

A method of folding a printed product is also provided. The steps include cutting a web so as to form a signature having lead edge tabs, the signature having perforation slots; and folding the signature so that the lead edge tabs enter the perforation slots.

A signature is also provided. The signature includes a lead edge including tabs, a tail edge opposite the lead edge, perforation slots between the lead edge and the tail edge, a first fold line between the lead edge and the perforation slots and a second fold line along the perforation slots. The signature is folded along the first fold line and the second fold line, the perforation slots receiving and engaging the tabs.

BRIEF DESCRIPTION OF THE DRAWINGS

The present invention is described below by reference to the following drawings, in which.

DETAILED DESCRIPTION

Figure 1:
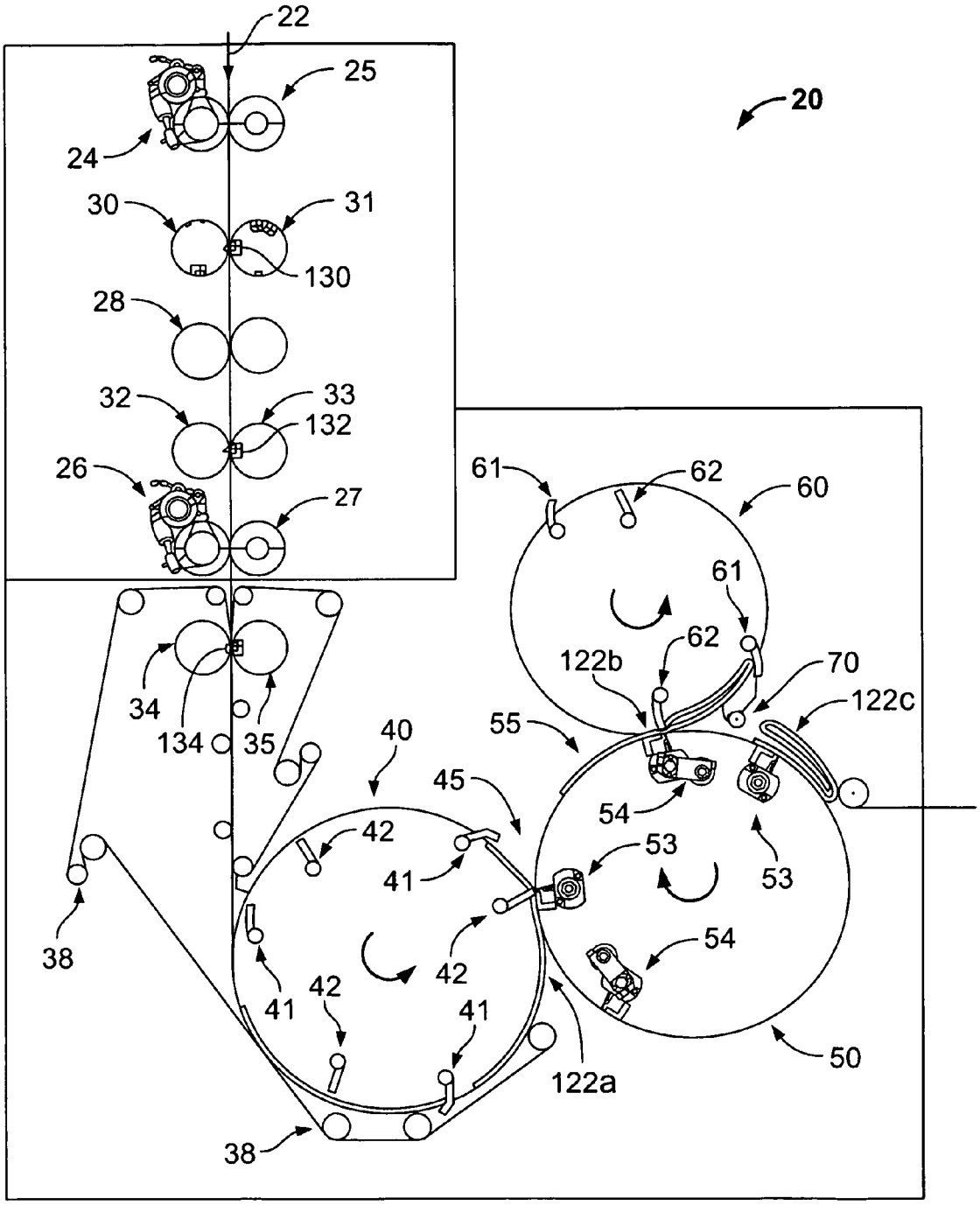
FIG. 1 shows a schematic side view of a folding apparatus according to an embodiment of the present invention.

FIG. 1 shows a schematic side view of a web 22 entering a folding apparatus 20 according to an embodiment of the present invention. Web 22 as defined herein can include a plurality of ribbons. Nip rollers 24, 25, 26, 27 transport web 22 into folding apparatus 20 and can help maintain proper orientation of web 22. Perforating cylinders 30, 31 cross perforate web 22 with a cross perforating blade 130. Web 22 may pass through a creaser 28 after web 22 is cross perforated. First cutting cylinders 32, 33 cut web 22, while web 22 passes between cylinders 32, 33, with a first cutting blade 132. First cutting blade 132 may create slits 142 (FIG. 2) in web 22 in a manner that partially defines a tail edge 124 (FIG. 2) of a signature 122 (FIG. 2), while partially defining tabs 334 (FIG. 2) on a lead edge 323 (FIG. 2) of a second signature that may be formed after signature 122. Second cutting cylinders 34, 35 may cut web 22, while web 22 passes between cylinders 34, 35, with a second cutting blade 134. Second cutting blade 134 may create slits 144 (FIG. 2) in web 22 in a manner that finishes defining tail edge 124 (FIG. 2) of signature 122 (FIG. 2), while finishing defining tabs 334 (FIG. 2) on a lead edge 323 (FIG. 2) of a second signature that may be formed after signature 122.

After web 22 has been perforated by perforating cylinders 30, 31 and cut by first and second cutting cylinders 32, 33, 34, 35, successive signatures 122 (FIG. 2) are formed. Successive signatures 122 (FIG. 2) may be one or more sheets thick. In an alternative embodiment perforating cylinders 30, 31 may perforate signatures 122 (FIG. 2) after web 22 has been cut into signatures 122 (FIG. 2) by cutting cylinders 32, 33, 34, 35. Accelerating tapes 38 may help guide the signatures 122 (FIG. 2) as signatures 122 pass from cutting cylinders 34, 35 to a collection cylinder 40. Signatures 122 (FIG. 2) are gripped by first grippers 41 on collection cylinder 40. FIG. 1 shows first gripper 41 on collection cylinder 40 gripping a signature 122*a*. Signature 122*a* gripped by gripper 41 is passing through a nip 45 formed by collection cylinder 40 and a jaw cylinder 50. A first tucking blade 42 begins to force a portion of signature 122*a* into a first jaw 53 of jaw cylinder 50. As first tucking blade 42 forces a portion of signature 122*a* in first jaw 53, first jaw 53 may engage signature 122*a*, forming a first cross-fold on signature 122*a*. Gripper 41 then releases signature 122*a* and first jaw 53 transports signature 122*a*, via rotation of jaw cylinder 50 about an axis of jaw cylinder 50, to be gripped by a second gripper 61 on a delta cylinder 60.

Figure 8:
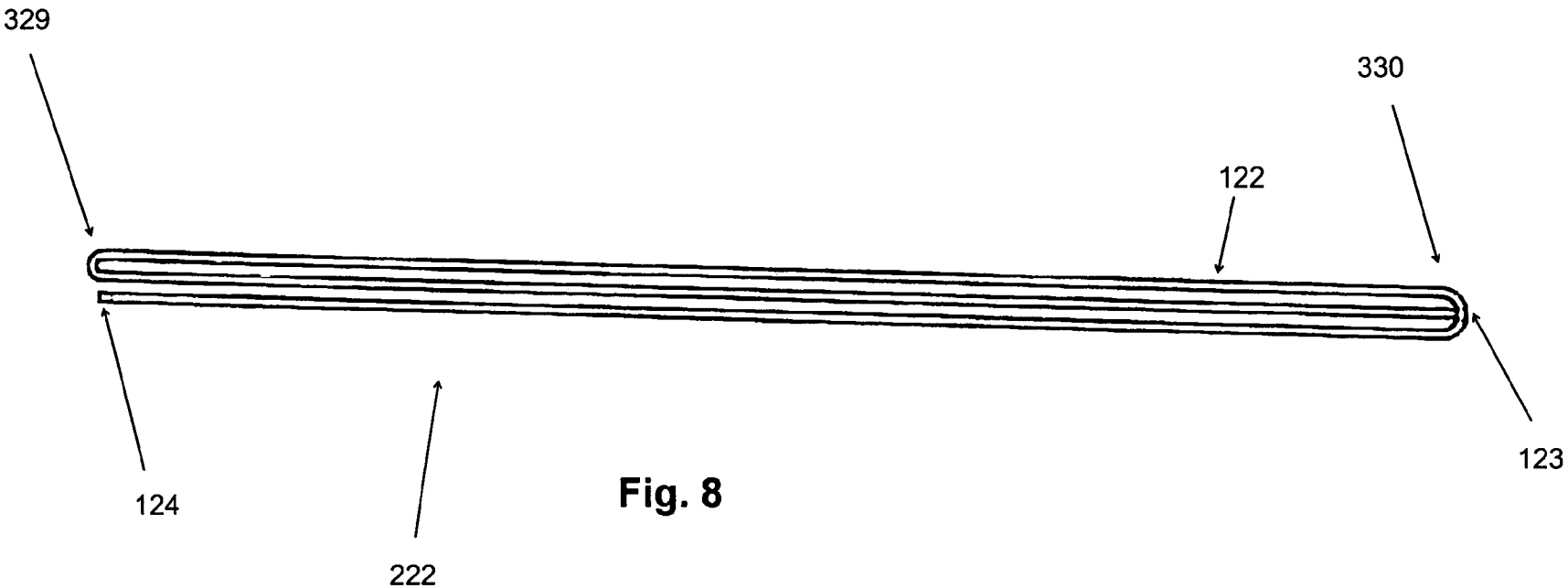
FIG. 8 shows a schematic side view of the signature shown in FIG. 2 folded as a final delta product.

A signature 122*b*, which has already been first cross-folded by first tucking blade 42 and first jaw 53, is gripped by a second gripper 61 on delta cylinder 60 as signature 122*b* passes through a nip 55 formed by jaw cylinder 50 and delta cylinder 60. A second tucking blade 62 on delta cylinder 60 may be beginning to force a portion of signature 122*b* into a second jaw 54 of jaw cylinder 50. As second tucking blade 62 forces a portion of signature 122*b* into second jaw 54, second jaw 54 may engage signature 122*b*, forming a second cross-fold, or delta-fold, on signature 122*b*. After signature 122*b* is delta-folded by second tucking blade 62 and second jaw 54, while still engaged by second jaw 54, signature 122*b* passes through a nip formed between a finishing roller 70 and jaw cylinder 50 to complete the delta-fold of signature 122*b*. A signature 122*c*, adjacent to a surface of jaw cylinder 50, has been first cross-folded by first tucking blade 42 and first jaw 53 and delta-folded by second tucking blade 62 and second jaw 54 to form a final delta product 222 (FIG. 8).

Figure 2:
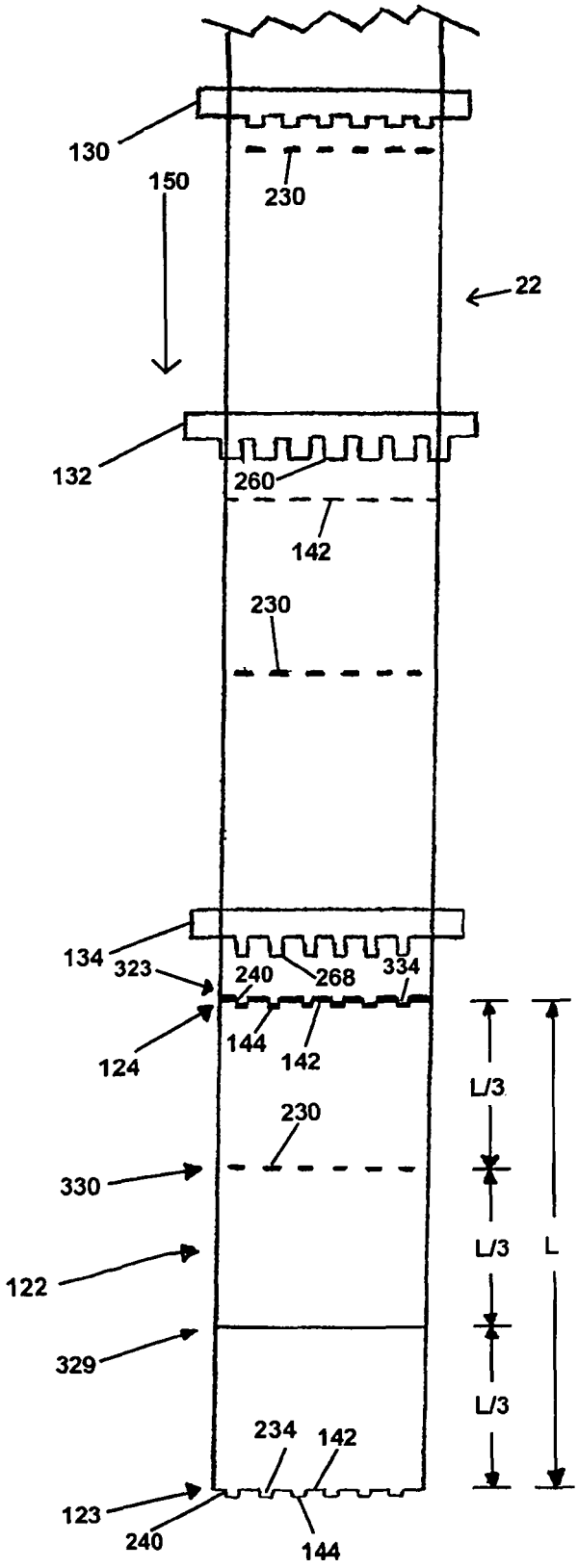
FIG. 2 shows a schematic top view of an unfolded signature formed into a delta product by the folding apparatus shown in FIG. 1, with a perforation blade, a first cutting blade and a second cutting blade schematically arranged to illustrate where the perforation blade, the first cutting blade and the second cutting blade have acted to form the signature.

FIG. 2 shows a schematic top view of a signature 122 cut from web 22 by cutting blades 132, 134, and perforated by perforating blade 130, according to the embodiment of the invention show in FIG. 1. Perforation blade 130, first cutting blade 132 and second cutting blade 134 are schematically arranged to illustrate where perforation blade 130, first cutting blade 132 and second cutting blade 134 act on web 22. Second cutting blade 134 may be located downstream, in relation to a direction 150 of web 22 travel, of first cutting blade 132 and perforation blade 130, with first cutting blade 132 located downstream of perforation blade 130. In alternative embodiments, blades 130, 132, 134 can be arranged differently in relation to direction 150.

Signature 122 includes a lead edge 123 and a tail edge 124. Each cutting blade 132, 134 is segmented and has spaced teeth 260, 268, respectively, that pierce web 22 during cutting. Thus, cutting blades 132, 134 cut slits 142, 144, respectively, in web 22. Slits 144 made in web 22 by teeth 268 are aligned in between slits 142 made in web 22 by teeth 260, in a manner that separates web 22 into successive signatures 122. Slits 142, 144 define leading edge 123 of signature 122, while severing a preceding signature from web 22 and defining a tail edge of the preceding signature. Cutting blades 132, 134 cut web 22 so that slits 142 are longitudinally offset from, or staggered behind, slits 144, in relation to direction 150 that web 22 travels. This offset cutting creates tabs 234 at leading edge 123, which has a staggered arrangement. Slits 142, 144 cut by cutting blades 132, 134, respectively, also define tail edge 124 of signature 122. Tail edge 124 may have a staggered arrangement similar to lead edge 123. When slit 144 is cut in web 22, tail edge 124 of signature 122 is formed and signature 122 is created from web 22. Boundaries 240, connecting slits 142, 144, are also defined in forming lead edge 123 and tail edge 124 of signature 122, by severing web 22. Boundaries 240 may be created by tearing of web 22 caused by tension exerted on web 22, after web 22 is cut by cutting blades 132, 134. Alternatively, one or both of blades 132, 134 may have teeth 260, 268, respectively, shaped to define boundaries 240, or one or more separate longitudinally extending blades may be provided.

Signature 122 is of a length L and includes perforation slots 230 created by perforation blade 130. Perforation slots 230 are located parallel to lead edge 123 and tail edge 124 at a distance approximately equal to one-third of length L of signature 22 (L/3) from tail edge 124 and a distance approximately equal to two-thirds of length L of signature 22 (2L/3) from lead edge 123. Perforation slots 230 of signature 122 are sized to engage tabs 234 of signature 122 as signature 122 is delta-folded along a second fold line 330, which may be substantially defined by perforation slots 230. A first fold line 329 is shown to illustrate where signature 122 is first cross-folded before signature 122 is delta-folded. First fold line 329 runs parallel to second fold line 330 and lead edge 123. First fold line may be located a distance equal to one-third the length L of signature 122 (L/3) from lead edge 123, a distance equal to two-thirds the length L of signature 122 from tail edge 124 (2L/3) and distance equal to one-third the length L of signature 122 (L/3) from second fold line 330 and perforated slots 230.

Slits 142, 144 and boundaries 240 defining tail edge 124 of signature 122 also define what may be leading edge 323 of a second signature to be created after signature 122. Accordingly, perforation slots 230 and slits 142 have been created between blades 132, 134 in web 22 by perforation blade 130 and cutting blade 132, respectively. Blade 134 may cut web 22 as web 22 travels in direction 150, and boundaries 240 may be created to define a tail edge of the second signature. Between blades 130, 132, perforation slots 230 have been created in web 22, which may be included in a third signature following the second signature.

In an alternative embodiment, cutting blades 132, 134 may be replaced by a single cutting blade which is shaped to cut web 22 to create signatures 122 with lead edge 123 having a staggered arrangement and including tabs 234. Tail edge 124 may also be created by this single cutting blade with a staggered arrangement or can be created with or without a staggered arrangement by another blade.

Figure 3:
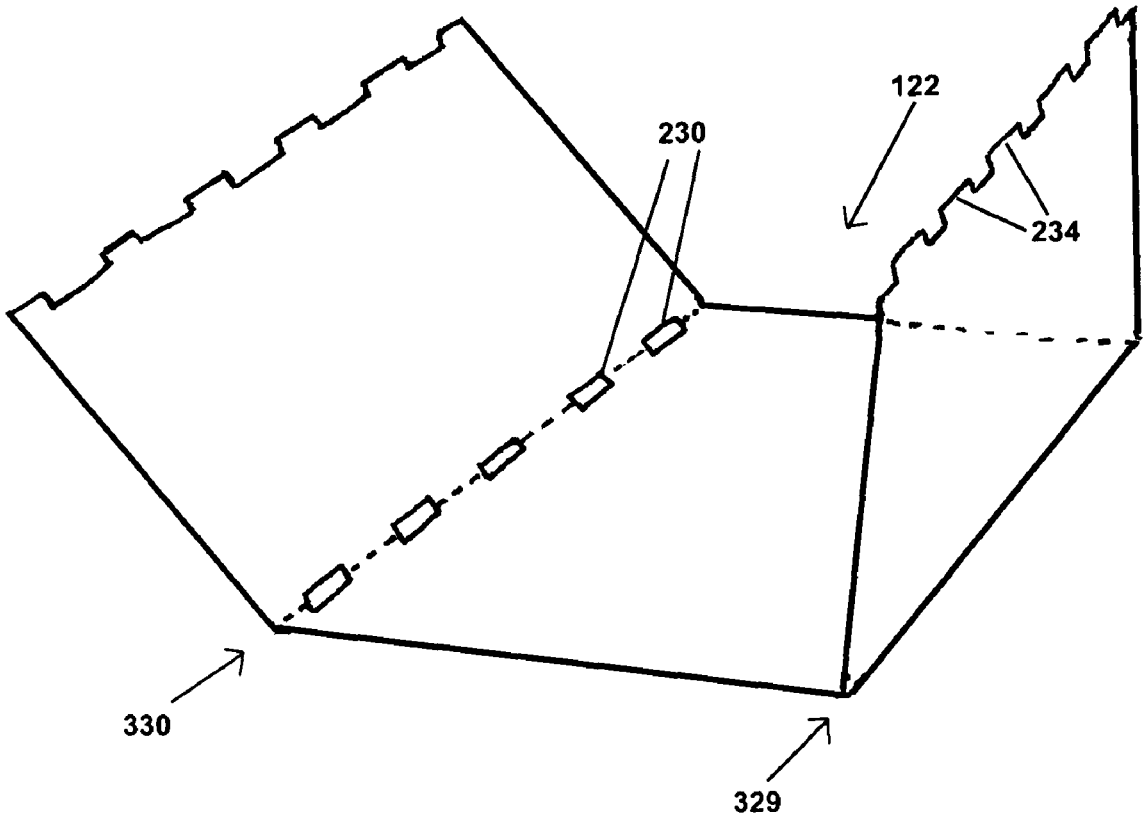
FIG. 3 shows a perspective view of the signature shown in FIG. 2 as an open delta product.

FIG. 3 shows a perspective view of signature 122 shown in FIG. 2 as an open delta product. Signature 122 has been folded along first and second fold lines 329, 330. Perforation slots 230 are sized to receive lead edge tabs 234.

Figure 4:
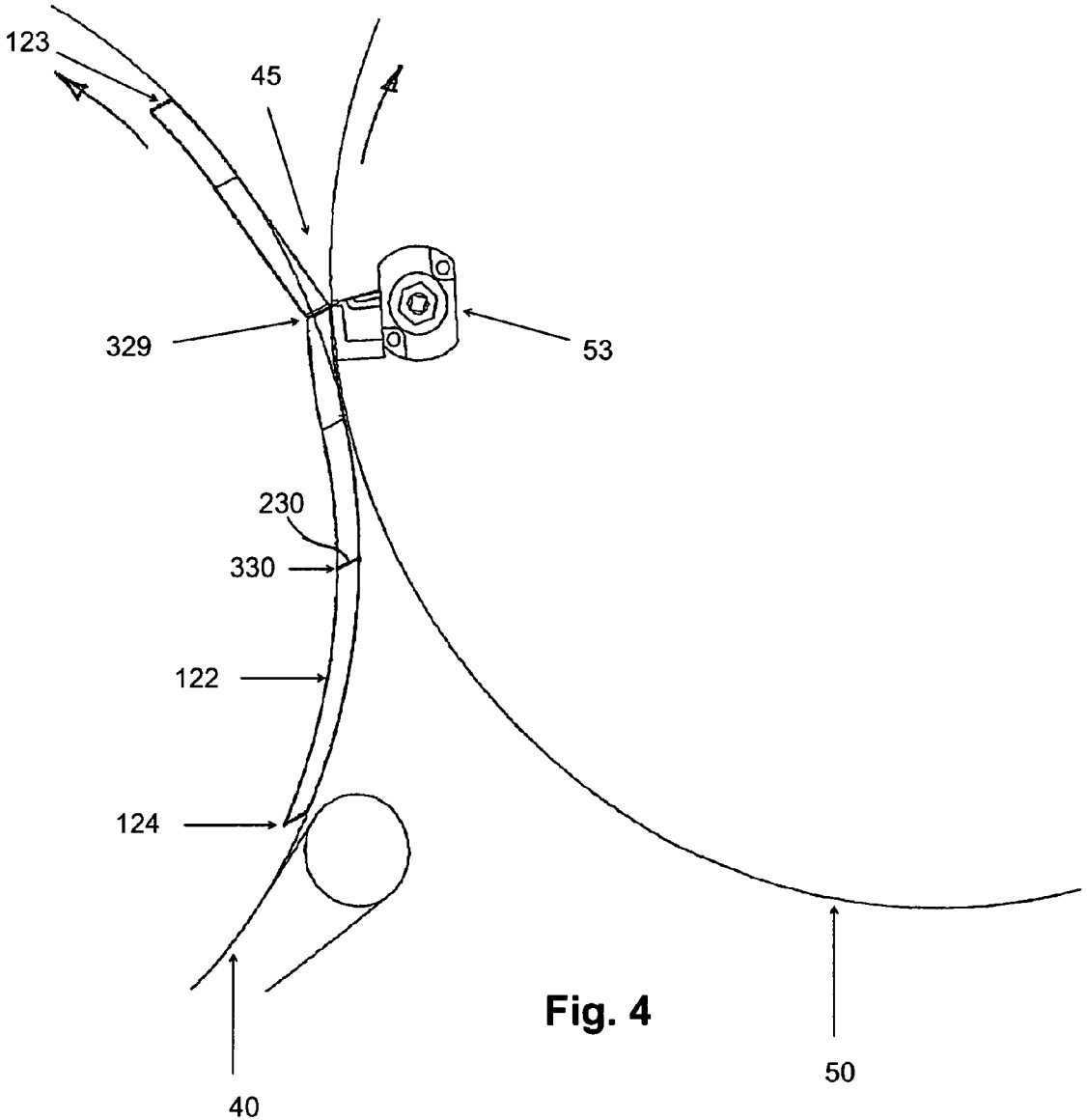
FIG. 4 shows a enlarged schematic perspective view of the signature shown in FIG. 2 engaged by a first jaw shown in FIG. 1.

FIG. 4 shows an enlarged schematic perspective view of signature 122 shown in FIG. 2 engaged by first jaw 53 shown in FIG. 1. Signature 122 is being first cross-folded at first fold line 329 at nip 45 and is being rotated about an axis of jaw cylinder 50 by first jaw 53, via rotation of jaw cylinder 50. Lead edge 123 of signature 122 has already passed between nip 45. Signature 122 includes perforation slots 230 along second fold line 330, which, along with tail edge 124 of signature 122 is located adjacent a surface of collection cylinder 40, which is being rotated about an axis of collection cylinder 40.

Figure 5:
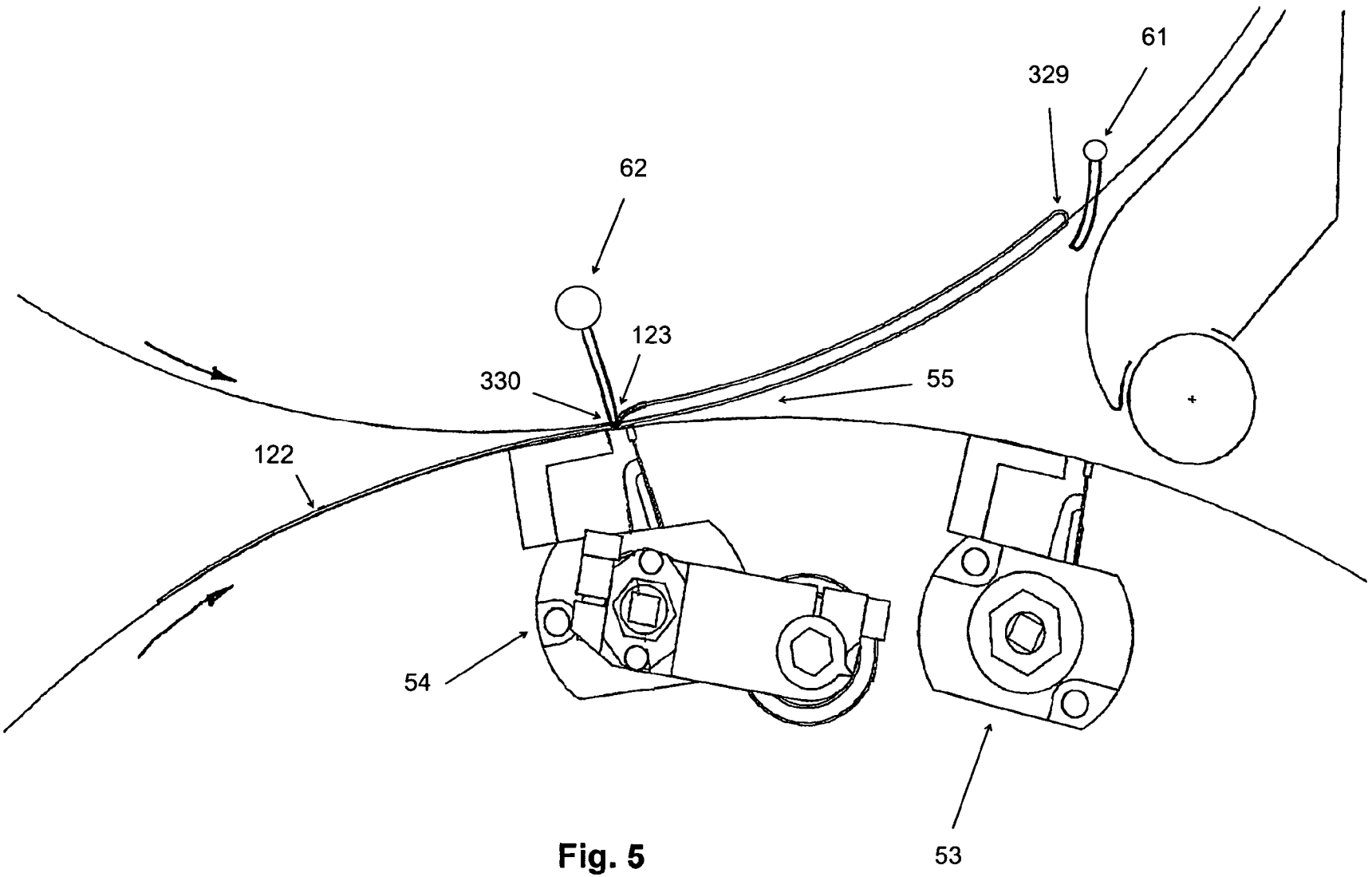
FIG. 5 shows a schematic enlarged side view of the signature shown in FIG. 2 being delta-folded by a second tucking blade and a second jaw shown in FIG. 1.

FIG. 5 shows a schematic enlarged side view of signature 122 shown in FIG. 2 being delta-folded by second tucking blade 62 and second jaw 54 shown in FIG. 1. Signature 122 has been first cross-folded at first fold line 329 by first jaw 53 and is beginning to be delta-folded, or second cross-folded, at second fold line 330 as signature 122 passes through nip 55. Prior to the operations shown in FIG. 5, first jaw 53 released signature 122 and signature 122 was gripped by second gripper 61. In FIG. 5, gripper 61 has just released signature 122. Second tucking blade 62 is tucking lead edge 123 so that lead edge tabs 234 (FIG. 2) enter, and are removably engaged by, perforation slots 230 (FIG. 2) in a manner latching lead edge tabs 234 into place inside perforation slots 230 while signature 122 is delta-folded. As an advantageous result, lead edge 123 does not dislodge from second jaw 54 as signature 122 is engaged by second jaw 54 at second fold line 330. Latching of lead edge tabs 234 (FIG. 2) with perforation slots 230 (FIG. 2) advantageously may prevent dog-ear folds from forming at lead edge 123 of signature 122 and may also minimize skewing of signature 122. After second tucking blade has caused lead edge tabs 234 (FIG. 2) to enter perforation slots 230 (FIG. 2), second tucking blade 62 may retract away from second jaw 54 while second jaw 54 securely engages signature 122.

Figure 6:
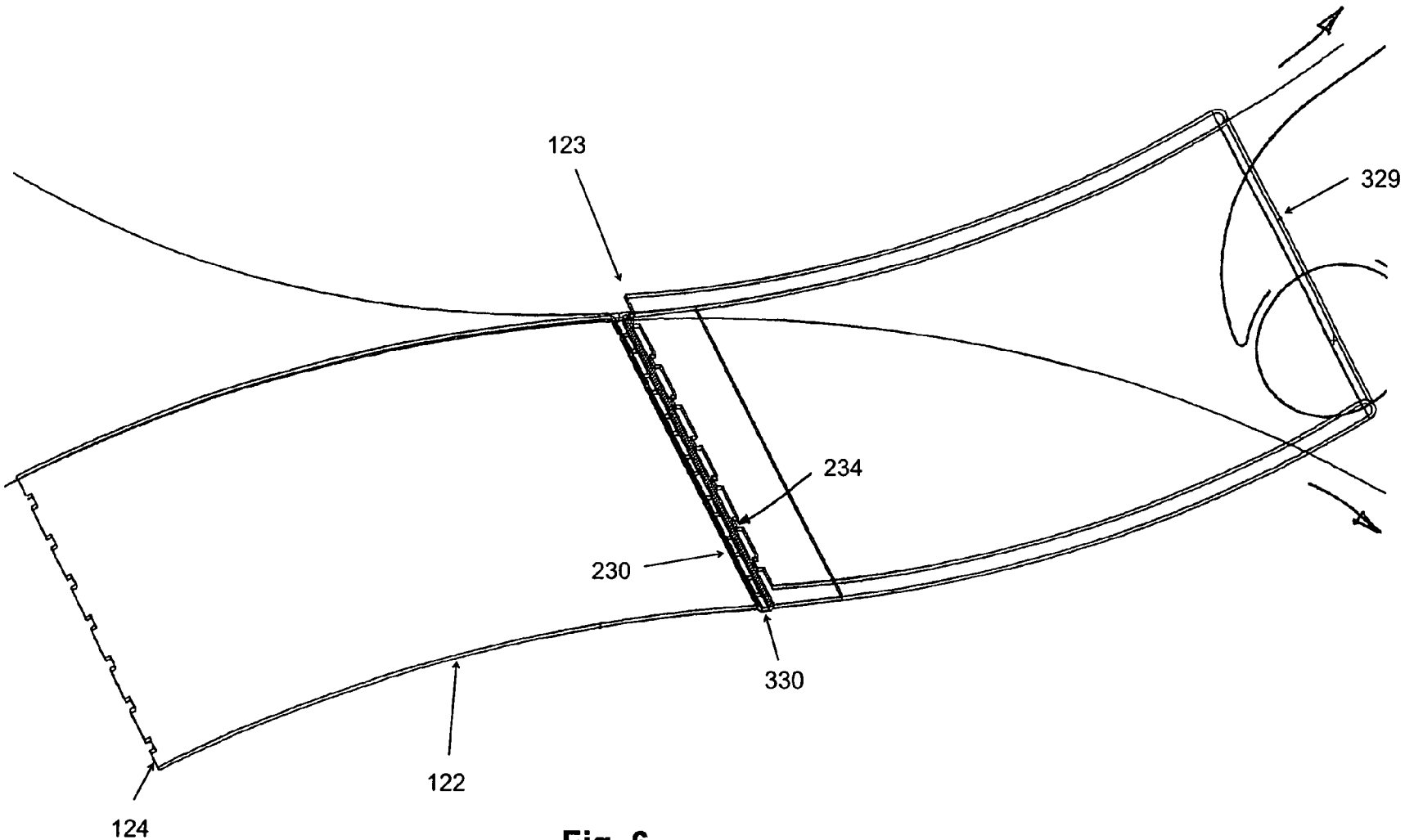
FIG. 6 shows a perspective view of the signature shown in FIG. 2 before lead edge tabs enter into perforation slots during delta-folding.

FIG. 6 shows a perspective view of signature 122 shown in FIG. 2 before lead edge tabs 234 enter into perforation slots 230 during delta-folding. Lead edge tabs 234 may be sized slightly smaller than perforation slots 230 so that lead edge tabs 234 can enter perforation slots 230 during delta-folding and so that lead edge tabs 234 do not slip out of perforation slots 230 as delta-folding at second fold line 330 is completed. Signature 122 has already been cross-folded along first fold line 329 so that lead edge 123 is adjacent to second fold line 330. When delta-folding is complete, tail edge 124 may be adjacent to first fold line 329.

Figure 7:
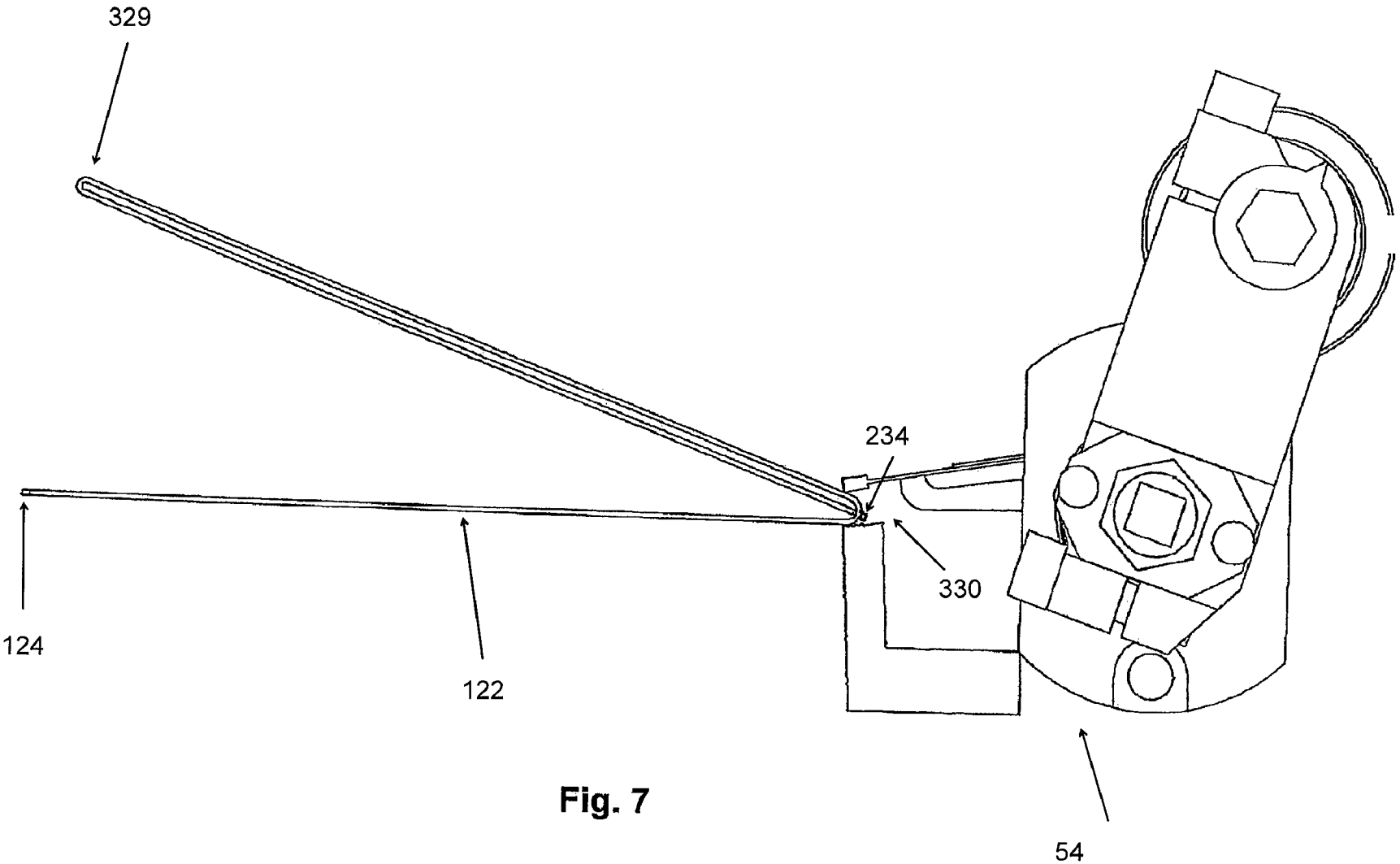
FIG. 7 shows a schematic side view of the signature shown in FIG. 2 being delta-folded with lead edge tabs engaged by perforation slots and the signature is engaged by the second jaw shown in FIG. 1.

FIG. 7 shows a schematic side view of signature 122 shown in FIG. 2 being delta-folded with lead edge tabs engaged by perforation slots 230 and signature 122 is engaged by second jaw 54. Second jaw 54 may be clamping signature 122 so that signature 122 does not become misaligned as delta-folding of signature 122 is completed. Lead edge tabs 234 have entered into perforation slots 230 (FIG. 2) and are shown passing through perforation slots 230 at second fold line 330. As delta-folding of signature 122 is completed first fold line 329 travels towards tail edge 124.

FIG. 8 shows a schematic side view of signature 122 shown in FIG. 2 folded as a final delta product 222. Signature 122, folded as a substantially flat delta product, is folded into three sections. A first section is defined between tail edge 124 and second fold line 330, at which signature 122 is folded. A second section is defined between second fold line 330 and first fold line 329, at which signature 122 is folded. A third section is defined between first fold line 329 and lead edge 123. The third section is between the first and second sections. Lead edge tabs 234 (FIG. 2) are passing through perforation slots 230 (FIG. 2).

The present invention may prevent inner sheets of delta products from being pulled out of second jaws 54 (FIG. 1) by second tucking blades 62 (FIG. 1) as second tucking blade 62 retracts while signature 122 is delta-folded. Even if only a small corner of lead edge 123 (FIG. 2) is dislodged from second jaws 54 (FIG. 1) a dog-ear fold can be created on inner sheets of signature 122. Prior attempts to prevent dog-earring during delta-folding include using a two millimeter lap on an open end of inner sheets, which gives signatures more bulk as signatures are gripped by second jaws, making it difficult to pull out the inner sheets. Dog-earring can be further prevented by flatter geometry of a second fold off guide, which may put less bending force on the inner sheets so the laps do not pop out of the second jaws. Also, second jaws may include second jaw blades that pierce signatures to maintain a hold on inner sheets as signatures are gripped by second jaws.

In the preceding specification, the invention has been described with reference to specific exemplary embodiments and examples thereof. It will, however, be evident that various modifications and changes may be made thereto without departing from the broader spirit and scope of invention as set forth in the claims that follow. The specification and drawings are accordingly to be regarded in an illustrative manner rather than a restrictive sense.

What is claimed is:

1. An apparatus for cutting and folding printed products comprising:

a perforator;

a first cutting device creating first slits in a web;

a second cutting device creating second slits in the web longitudinally offset from the first slits so as to form a signature with a staggered edge; and a folder delta-folding the signature so that the staggered edge engages slots in the signature, the slots created by the perforator.

2. The apparatus for cutting and folding printed products recited in claim 1 wherein the perforator perforates slots in the web.

3. The apparatus for cutting and folding printed products recited in claim 1 wherein the folder includes a jaw cylinder having a jaw that engages the signature after the staggered edge is engaged by the slots, the staggered edge remaining in the slots as the jaw engages the signature.

4. The apparatus for cutting and folding printed products recited in claim 1 wherein the first cutting device includes a first cutting blade having first teeth and the second cutting device includes a second cutting blade having second teeth and the first teeth cut the web at a first position trailing a second position where second teeth cut the web, the first teeth and the second teeth forming the staggered edge of the signature.

* * * * *